US005187322A

United States Patent [19]

Schloss et al.

[11] Patent Number: 5,187,322

[45] Date of Patent: Feb. 16, 1993

[54] PROCESS FOR CONTROLLING THE DETONATION OF A MINE AND MINE WITH TRIGGERING DEVICE OPERATING IN ACCORDANCE WITH THE PROCESS

[75] Inventors: Jurgen Schloss, Oberasbach; Gunther Trummer, Baiersdorf; Harald Wich, Schwaig, all of Fed. Rep. of Germany

[73] Assignee: Diehl GmbH & Co., Nuremberg, Fed. Rep. of Germany

[21] Appl. No.: 475,606

[22] Filed: Mar. 14, 1983

[30] Foreign Application Priority Data

Mar. 19, 1982 [DE] Fed. Rep. of Germany ..... 3210207

[51] Int. Cl.[5] ..... F42C 14/08; F42C 13/02

[52] U.S. Cl. ..... 102/427

[58] Field of Search ..... 102/427, 213, 214

[56] References Cited

U.S. PATENT DOCUMENTS

| | | | |
|---|---|---|---|
| 3,304,864 | 2/1967 | Thomanek | 102/427 |
| 3,509,791 | 5/1970 | Pechamat et al. | 102/427 |
| 3,913,484 | 10/1975 | Gardner | 102/427 |
| 4,056,061 | 11/1977 | Becklund | 102/213 |
| 4,398,466 | 8/1983 | Sepp et al. | 102/427 |

FOREIGN PATENT DOCUMENTS

| | | | |
|---|---|---|---|
| 2039445 | 1/1979 | United Kingdom . | |
| 2063430 | 6/1981 | United Kingdom | 102/214 |
| 2108244 | 5/1983 | United Kingdom | 102/427 |

*Primary Examiner*—Charles T. Jordan

*Attorney, Agent, or Firm*—Scully, Scott, Murphy & Presser

[57] ABSTRACT

A process for controlling the detonation of a mine for the combating of vehicles, in particular armored vehicles such as tanks, with an electronically-triggered detonating arrangement and, a mine including a triggering device which is actuated pursuant to the inventive process. The detonating arrangement is only triggered when a receiver which is connected ahead thereof has determined requisite, preset aggregate vehicular criteria in a vehicle approaching the mine. The receiver is provided with a pattern comparator which is supplied from a pattern storage in accordance with a pregiven vehicular type criterium and with a detector receiving signal from the currently detected vehicle.

4 Claims, 1 Drawing Sheet

PROCESS FOR CONTROLLING THE DETONATION OF A MINE AND MINE WITH TRIGGERING DEVICE OPERATING IN ACCORDANCE WITH THE PROCESS

BACKGROUND OF THE INVENTION

1. Field of the Invention

The present invention relates to a process for controlling the detonation of a mine for the combating of vehicles, in particular armored vehicles such as tanks, with an electronically-triggered detonating arrangement and, moreover, relates to a mine including a triggering device which is actuated pursuant to the inventive process.

2. Discussion of the Prior Art

In order to combat naval vessels, land vehicles or aircraft it is known to employ mines whose detonating arrangements are activated through the intermediary of electronically-controlled triggering devices; for example, upon contact or, in the case of remote-effect mines, upon the reaching of a predetermined degree of proximity.

The present invention is predicated on the recognition that the tactical effectiveness of mines can be improved when they respond only selectively to objects, the combating of which is particularly rewarding or, respectively, particularly essential, so that the effect of laid down distributed or ejected mines will not become purposeless when they are brought to detonation by objects which are not rewarding from a military standpoint.

Based on the foregoing recognition, the present invention has as its object the provision of a process and of a mine of that constructional type which leads to an enhanced degree of mine effectiveness.

SUMMARY OF THE INVENTION

Accordingly, it is an object of the present invention to provide a process of the type described in which the detonating device is only triggered when a receiver which is connected ahead thereof has determined requisite, preset aggregate vehicular criteria from a vehicle approaching the mine.

Another object of the present invention is to provide a mine which is detonated pursuant to the foregoing process, wherein the receiver is provided with a pattern comparator which is supplied from a pattern storage in accordance with a pregiven vehicular type criterium and with a detector receiving signal from the currently detected vehicle.

For such vehicular type criteria, pursuant to which there is to be initiated the triggering of the mine detonating arrangement, there is especially adapted the noise which is generated during the traveling motion of the vehicle, such as the frequency spectrum of the sound waves projected from the moving vehicle into the surrounding medium. This frequency spectrum will evidence characteristic distinctions in accordance with the vehicle type, such as for a truck in comparison with a tank. These signals are detected by a receiver which is designed for this purpose, analyzed and compared with a pregiven pattern as the criterium for the type of vehicle construction, at the approach of which they should trigger. At all times, the analysis of such a frequency spectrum; for example, in the manner of the digitally-calculated Fourier analysis, is quite complex in regard to its circuitry. The requirement for an inexpensive receiver for the function of such an "intelligent mine" is, however, not optional; a simplified process based on this signal processing can always be of use as a socalled waking function in order to activate further evaluating criteria, particularly such as those described hereinbelow.

Pursuant to a modification of the invention, provision is made that the prerequisite pattern and for the receipt of the vehicle type criteria be based on the heat radiation distribution of the operatively warm vehicle. Within the context of the invention there can, as a result, be made provision that by means of a receiver arrangement of infrared detector elements there can be obtained a radiation scanning pattern of the vehicle, approaching the mine or its receiver, to extrapolate image with respect to typical radiation distributions, and to classify it through predetermined patterns.

Since the scanning pattern in the direction of movement of the vehicle will produce itself through a time-serialized signal processing during the course of the approach, or upon the moving past of the vehicle, it merely requires a one-dimensional arrangement of infrared receiver elements, essentially grouped for a spatial receiving segment which is not located in the plane of the direction of movement of the vehicle and, preferably, stands perpendicular relative to this plane of movement. Scanned hereby is the radiation distribution in vertical elevation across the vehicle profile; namely, strip-shaped transverse to the direction of the continual vehicle movement. Obtained through these scanning strips is an infrared line image with respect to the contours of the vehicle; in effect, a contour profile representation with consideration given in the scanning pattern to the varying intensity distribution of the heat irradiation of the vehicle. Since the contour of a tank will clearly distinguish from the contour of, for example, a jeep or a truck, from a comparison with the typical pattern of a tank signature there is obtained the criterium for triggering of the detonating arrangement and, consequently, for the detonation of the mine for combating of only the type of object which is of interest. Disadvantageous for this solution is always the high cost for a receiver arrangement of that type which must be combined from a line grouping of selective infrared elements completely correlated with each other in their response characteristic. Also this component can be too expensive for the sought for, economical mass product, which as a rule is not reusable, in the form of the receiver for an "intelligent mine", of the herein contemplated type.

Pursuant to a further modification leading to a preferred embodiment of the invention, there is considered the elimination of this raster-like scanning for obtention of the contour of the detected vehicle and, in lieu thereof, to determine the heat radiation of the detected vehicle through parallel-offset scanning strips relative to the vehicle moving through a strip-shaped action receiving characteristic at the present signal processing timepoint. Obtained therefrom is then (in lieu of the edge profile with the radiation intensity appearing in the represented geometry as brightness modulation) a distribution of the radiation intensity, determined transverse to the direction of vehicle movement, across the length of the vehicle in its direction of locomotion. Again, this is also typical for different types of vehicles. Thus, for a tank, following its profile from forwardly to the rear, the radiation intensity rises initially ramp-like so as to then remain somewhat constant; it makes a jump in the region of the turret, and within a short time drops off to a constant value, and then again rises extremely steeply high up and then drops down to zero; namely, in the region behind the engine which is located in the rear end portion. In contrast therewith, the lengthwise distribution of the radiation intensity determined transverse of a truck moving in the same direction past the receiver typically differs therefrom; namely in the region of the engine block and the driver cab it increases steeply and is relatively high, drops down to a lower constant value in the region of the load section, rises somewhat once again for a short period in the region of the rear axle differential, and then drops down to zero. Only when the typical intensity jumps occur in a typical sequence can there be determined any correlation with the stored pattern, and the mine is then selectively detonated since it has been approached by a vehicle which it is intended to combat.

Such an infrared receiver for that type of obtained radiation intensity detection in a strip-shaped receiving area can consist of a single detector element which, preferably, has an optic connected ahead thereof for the blending of the spatial sector transverse to the plane of movement of the vehicle and for enhancing of the received radiation energy. Preferably employed is a single detector element which, in contrast with the usual geometry, is not edged so as possibly be limited to point-shape, but is formed as an elongated strip so as to directly provide the median value formation through the instantaneous scanning strip. The utilization of such a detector element no longer represents a significant cost factor since it need no longer be correlated with respect to coacting further elements which cooperate therewith.

There is thus obtained an inexpensive capability for the selective triggering of the detonating mechanism of a mine in accordance with the appearance of predetermined vehicles within its destructive range, whose vehicle type criteria are easily determined and wherein, with a comparatively low requirement, they can be compared with stored criteria having the same signal characteristics.

BRIEF DESCRIPTION OF THE DRAWINGS

Reference may now be had to the following detailed description of the invention elucidating further advantages and features thereof, taken in conjunction with the accompanying drawings; in which.

DETAILED DESCRIPTION

Figure 1:
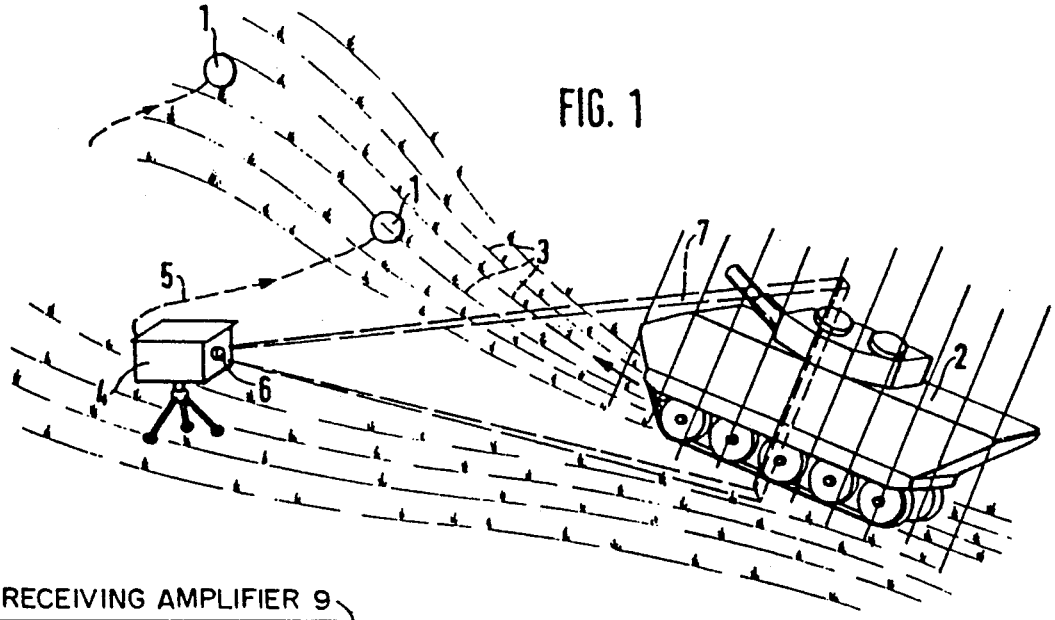
FIG. 1 illustrates a generally schematic representation of a receiver positioned towards one side of a deposited mine for determining the type criteria of a vehicle approaching the mine.
Figure 2:
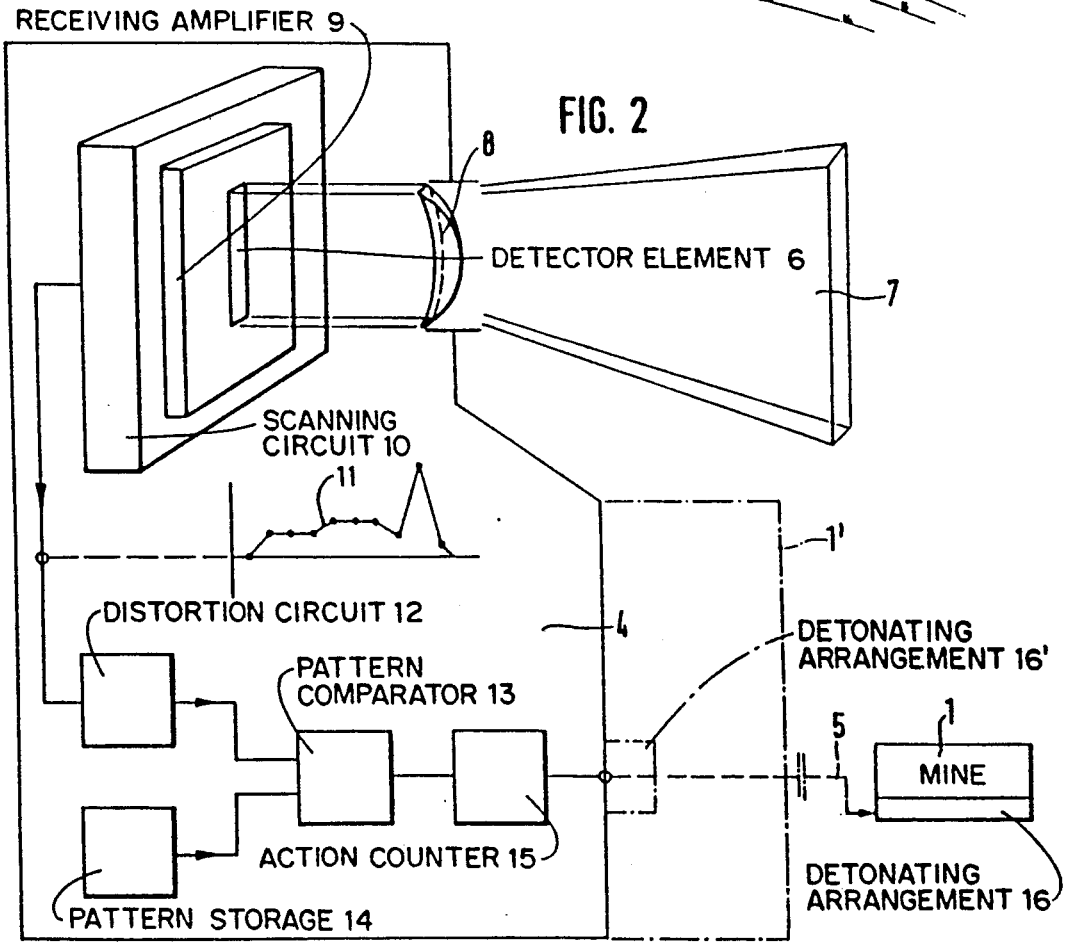
FIG. 2 is a schematic circuit block diagram representing the principle of a signal processing effectuated within the receiver.

The scene represented in FIG. 1 illustrates a tank 2 as the type of vehicle approaching a mine 1 laid in the terrain. In the illustrated exemplary embodiment, a receiver 4 is positioned towards one side of the mine 1, and consequently also towards one side of the path of movement 3 of the tank 2, preferably in an elevated region of the terrain, which is in an operative connection either wirelessly or through a wire with its mine 1 through a control connection 5. However, in lieu thereof or additionally thereto, as is symbolically illustrated in FIG. 2, there can be employed a socalled remote-effect mine 1' which is built in directly together with the receiver 4, such as when the presumed path of movement 3 cannot be previously determined with sufficient probability.

The receiver 4 operates with an infrared detector element 6 which in the distant range evidences a spherical receiving characteristic. The desired strip shaped characteristic 7 is obtained through the utilization of a geometrically conforming optic 8 which, in the illustrated principle representation, is indicated as consisting of a lens, which in actual practice, however, preferably can be constructed as a mirror with the location of the detector element 6 within its focal point. It is decisive that the interaction of a preferably strip-shaped detector element 6 and the optic 8 imparts the receiving characteristic with an opening pyramid of stretched cross-section so that there is detected a strip-shaped spatial segment perpendicular to the plane of movement of the tank 2. In the illustrated preferred exemplary embodiment, the receiving characteristic 7 is fixedly directed relative to the orientation of the receiver 4 in the terrain. Due to the locomotion of the tank 2 through the receiver characteristic 7, there is thus determined in the direction of the height of the vehicle, in effect transverse to the plane of movement, the heat radiation of the tank 2 in strip shapes which are offset relative to each other.

The receiving amplifier 9 which is connected to the output of the detector element 6 with a scanning circuit 10 controlled in timed sequence, delivers a mutually time-sequenced series of intensity values which correspond with the intensity of the heat radiation determined through the strips of the detected vehicle profile. Thus, at a correspondingly large number of scanned values there is produced a received curve plot 11 which, as can be ascertained from the raster structure entered therein for the tank 2 in FIG. 1, includes the more details the more frequently is scanned the receiving signal of the detector elements 6 during the course of the passage through the receiving characteristic 7.

Inasmuch as the length of the curve plot 11 over the time axis is dependent upon how rapidly the tank 2 (FIG. 1) traverses the receiving characteristic 7, there can be provided in the receiver 4, for instance behind the scanning circuit 10, a distortion circuit 12 which expands or compresses the curve plot 11 to a standard representative length; for example through uniform distribution of the sequence of the quantitized intensity median values among the storage positions of a storage of predetermined capacity. Thereafter the accordingly processed curve plot can be read out and directly compared in a pattern comparator 13 with a corresponding pregiven curve plot contained in a pattern storage 14 from the significant vehicle type criteria.

In lieu of such a comparison with a pregiven curve plot, information can also be contained in the pattern storage 14 with respect to predetermined characteristics of the curve plot 11, such as over the mere qualitative sequential series of lower, median and higher integration results. Eliminated thereby is a distortion of the received curve plot 11 with respect to a stored curve plot.

The output of the pattern comparator 13 can have an action counter 15 connected thereto which prevents the triggering of a detonating signal at already the first appearance of the sought for vehicle type criterium in the received curve plot 11, in order not to frighten away any following vehicles (tank 2) of the same type of construction, in that already the first tank 2 upon approaching the first of the mines 1 or mine 1' would cause these to detonate. In lieu thereof, the significant vehicle type criterium must appear a predetermined number of times before the detonating arrangement 16 or 16' of, respectively, mine 1 or 1' will be triggered. When a plurality of mines 1 or 1' are to be controlled in the same manner through the receiver 4, but with differently set action counters 15, it is possible to ensure thereby that first, and only upon the entering of a corresponding number of vehicles, all of types which are of interest, into the controlled terrain region, will concurrently detonate all of mines 1 laid therein and provide for a correspondingly greater tactical effect.

What is claimed is:

1. A process for controlling the detonation of a mine for the combating of vehicles; upon approach to said mine; comprising an electronically triggered detonating arrangement; and a receiver connected to said detonating arrangement for triggering said arrangement upon determination of predetermined, pregiven vehicle type criteria of said vehicle, said receiver determining the infrared radiation of the vehicle and comparing the vehicle criteria with a pattern provided as a detonation criterium, said receiver determining the infrared radiation of the vehicle along strips mutually offset against the direction of movement of the vehicle, and comparing said radiation with the characteristics of an intensity curve plot along said direction.

2. A process as claimed in claim 1, said receiver being arranged towards one side relative to the path of movement of the vehicle, and said receiver triggering said detonating arrangement upon the detection of a predetermined number of vehicles of the pregiven criteria.

3. In a mine for the combating of vehicles, comprising a detonating arrangement; and means for electronically triggering said detonating arrangement upon said mine being approached by said vehicle, said triggering means including an infrared receiver having a pattern comparator; said infrared receiver comprising a single, extended infrared detector element having a strip-shaped effective receiving characteristic; and a pattern storage supplying said comparator with a signal pursuant to a pregiven vehicle criterium and with a detector receiving signals from a currently detected vehicle.

4. A mine as claimed in claim 3, comprising a presettable action counter being connected to the output of said pattern comparator in said receiver.

* * * * *